United States Patent [19]

Johnson, Jr.

[11] Patent Number: 4,918,354

[45] Date of Patent: Apr. 17, 1990

[54] COMPACT COILED COIL INCANDESCENT FILAMENT WITH SUPPORTS AND PITCH CONTROL

[75] Inventor: Pierce Johnson, Jr., Topsfield, Mass.

[73] Assignee: GTE Products Corporation, Danvers, Mass.

[21] Appl. No.: 135,193

[22] Filed: Dec. 18, 1987

[51] Int. Cl.[4] ..... H01K 1/02; H01K 1/18

[52] U.S. Cl. ..... 313/279; 313/344; 313/273

[58] Field of Search ..... 313/279, 344, 273, 315, 313/579; 445/48

[56] References Cited

U.S. PATENT DOCUMENTS

| | | | |
|---|---|---|---|
| 4,208,609 | 6/1980 | Berlec | 313/315 |
| 4,316,116 | 2/1982 | Graves et al. | 313/344 |
| 4,499,401 | 2/1985 | Graves et al. | 313/344 X |
| 4,535,269 | 8/1985 | Tschetter et al. | 313/579 |
| 4,835,443 | 5/1989 | Benson et al. | 313/579 |

*Primary Examiner*—Donald J. Yusko
*Assistant Examiner*—Sandra L. O'Shea
*Attorney, Agent, or Firm*—Joseph S. Romanow

[57] ABSTRACT

This invention provides an improved compact fine wire incandescent lamp coiled-coil filament and method for making the same. The filament has a secondary mandrel ratio in the range of about 3.0 and a primary mandrel ratio which is less than or equal to the secondary mandrel ratio. The length between supports is kept less than or equal to 20 times the secondary diameter. The improved filament design exhibits an increase in compactness and retains or increases structural rigidity while exhibiting minimal sag when the filament is incorporated into an incandescent lamp of the tungsten halogen type variety. The compact coiling method is particularly useful in designing compact filaments for high voltage applications where it is desirable to eliminate the use of rectifying means to lower the effective voltage across the filament.

19 Claims, 3 Drawing Sheets

SINGLE HUNG

DOUBLE HUNG

TRIPLE HUNG

COMPACT COILED COIL INCANDESCENT FILAMENT WITH SUPPORTS AND PITCH CONTROL

FIELD OF THE INVENTION

The present invention is directed to a unique coiled coil incandescent filament and supports therefore, especially useful in a European version of Sylvania's Capsylite lamps. Both PAR and A-Line versions of these lamps are commercially available in the United States. The U.S. versions of these lamps are characterized by a low-wattage, tungsten-halogen, hard glass light-source capsule, mounted within a heavy outer envelope.

BACKGROUND OF THE INVENTION

The use of parabolic aluminized reflector (PAR), elliptical reflector (ER), or reflector (R) lamps for general spot, downlighting, and/or flood lighting applications is well established. In particular, R, PAR, and ER type lamps have been accepted as the lamps of choice for short to medium distance outdoor uses, as well as for indoor display, decoration, accent, and inspection applications of down lighting.

Traditionally, incandescent PAR-type lamps, particularly Sylvania's PAR38, have used a filament mounted transversely in the reflector, that is, perpendicular to its axis of symmetry, because this was the simplest configuration to manufacture.

The result of this configuration is an asymmetric beam pattern and the spreading of stray light outside of the useful beam. Additionally, the necessity of maintaining the proper atmosphere in the outer jacket required that the lamp be hermetically sealed with the lens flame-sealed to the reflector.

With the introduction of Sylvania's Capsylite PAR lamps, which use a halogen capsule as a light source, came lamps with axially mounted filaments which yield a more symmetric beam pattern and more efficient collection of light by the reflector into a useful beam.

Part of this gain in optical efficiency is due to the fact that the Capsylite lamps use a compact filament which more nearly approaches the theoretically ideal "point" source.

In Capsylite lamps operating under United States type electrical systems (i.e., 120–130 V; 60 Hertz) such compact filaments are made possible by the use of a halfwave rectifying diode which effectively reduces the capsule voltage from 120 V to about 84 V. Furthermore, since the atmosphere in the outer envelope is no longer critical because of the capsule, the lamp need not be hermetic and bonded beam lamps have appeared.

In European line voltage PAR lamps, typically of 220 to 250 V, halogen capsules have not been used because of the exceedingly fine wire that is required at this high voltage.

Low voltage (≦150 W), line voltage filaments tend to be long and flimsy, prone to sag and requiring multiple supports which reduce efficiency. Voltage reducing diodes cannot be used because they produce objectionable flickering of the filament when run on the 50 cycle AC which is standard in Europe.

"Folded" filaments tend to have detrimental interactions between adjacent sections of the filament which will reduce life.

Coiled filaments are known, see for example, U.S. Pat. Nos. 1,180,159; 1,247,068; 2,142,865; 2,306,925; 2,774,918; 4,208,609; and 4,316,116. However, none of these coiled filaments provides the unique features of the filament of the present invention.

Filament supports are also known, see for example, U.S. Pat. Nos. 4,359,665; 4,208,606; 3,708,333; 3,736,455; 3,678,319; 3,634,722; 3,335,312; and 3,173,051. However, previously employed filament supports typically caused problems in terms of shadowing and/or scattering of light.

While quartz halogen capsules in the 220–250 V range have been made, they are generally inefficient and complicated affairs with "zig-zagged" filaments and multiple coil supports.

Thus, conventional quartz capsules and the typical filaments and/or supports usually associated therewith, are not well suited for use in PAR lamps since they are lacking both in luminous efficiency and in optical efficiency, they are also more expensive to produce than hard glass capsules due to the high cost of materials and processes involved and the amount of labor required.

The present invention overcomes the difficulties mentioned above with respect to European type PAR and A-Line lamps by providing a unique filament and non-interfering supports therefore.

SUMMARY OF THE INVENTION

The present invention is directed to a low wattage (≦150 W) high voltage (120–250 V) halogen coil filament particularly well suited for use in European type PAR and A-Line lamps.

In particular the invention is directed to an improved halogen coil filament, the improvements including a compact high efficiency filament mounted axially in a single ended hard glass capsule with a unique system of supports sufficient to prevent significant coil sag over the useful life thereof.

The parameters of the filament of the present invention are new. A filament prepared in accordance with these parameters demonstrates improved compactness and structural rigidity which, together with the unique supplementary supports therefore, provide a suitable light-source for lamps operating under European electrical systems (220–250 volts and 50 Hertz).

DETAILED DESCRIPTION OF THE PREFERRED EMBODIMENTS

This invention preferably relates to a multiple coiled filament and system of supports. The filament consists of a single strand wire, coreless, coiled coil filament for an incandescent lamp. The supports allow a simple, inexpensive and efficient coil to be constructed.

Figure 1:
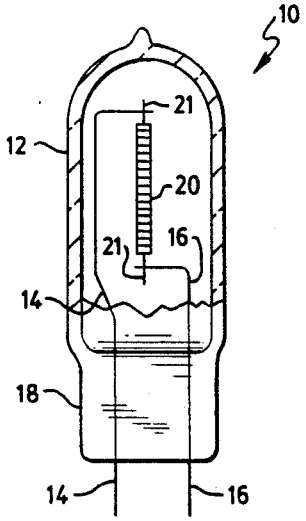
PRIOR ART FIG. 1
FIG. 1 illustrates one embodiment of an incandescent lamp, particularly of the tungsten halogen variety, made in accordance with the teachings of conventional lamp technology, suitable for modification in accordance with the teachings of the present invention.

FIG. 1 represents an example of an incandescent lamp 10, in this embodiment being of the tungsten halogen variety, prepared in accordance with the teachings of conventional lamp technology.

As illustrated, lamp comprises a tubular envelope 12, prepared from a suitably hard, light transmissive material, such as quartz, or aluminosilicate glass. A pair of lead in wires 14 and 16, portions of which serve as mounting means, are press sealed in envelope 12 at press seal 18.

Lead in wires 14 and 16 can be formed from any suitable material, for example, molybdenum, which will form a relatively strain free hermetic seal with glass envelope 12. A refractory metal, such as tungsten, is used to form the filament 20. The filament 20 is provided with legs 21 at each end thereof during its formation.

In this embodiment, envelope 12 is contains a fill gas, comprising an inert gas and a suitable halogen or halide. Preferred examples of fill gases useful herein include the inert gases; argon, krypton, xenon, and/or nitrogen; plus the halogen or halide.

As set forth above, the present invention is directed to an improved filament for use in incandescent lamps such as that depicted in FIG. 1.

Figure 2:
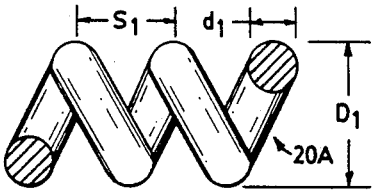
FIG. 2 illustrates a filament wire which was wound to form a coiled filament.
Figure 3:
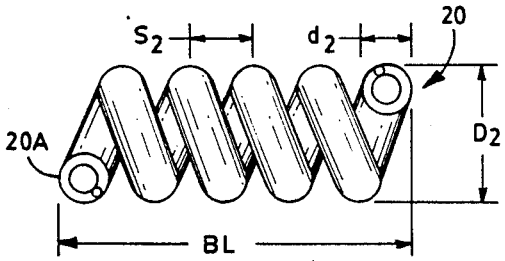
FIG. 3 illustrates a filament wire which was wound to form a coiled coil filament.

FIGS. 2 and 3 illustrate enlarged views of the preferred tungsten filament of the present invention and its coiled and coiled coil stages, respectively. Each stage has a pitch or percent pitch, which is equal to S, the center to center spacing of the turns, divided by d, the diameter of the wire or coil, multiplied by 100.

Specifically, FIG. 2 illustrates the primary pitch of a filament 20A having a center to center spacing of $S_1$, wire diameter $d_1$, and outer diameter $D_1$. In the present invention, the primary pitch $P_1$ is equal to $S_1/d_1$ and the secondary pitch $P_2$ is equal to $S_1/d_2$ (Note: $d_2$ $D_1$) Also, $P_1$ has a value that does not exceed about 1.55 (or 155%).

In FIG. 3, $S_2$ is the center to center spacing of the coiled coil filament, $d_2$ ($d_2=D_1$) is the primary coil diameter, and BL is the body length of the coiled coil (or secondary) filament. In preferred embodiments, the secondary pitch of the filament is in the range of from about 1.40 to about 1.75.

Figure 4:
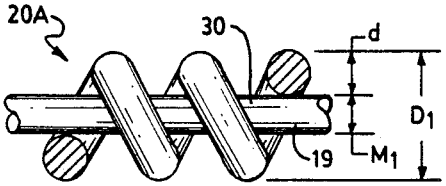
FIG. 4 illustrates a filament wire wound around a primary mandrel to form a primary coil.
Figure 5:
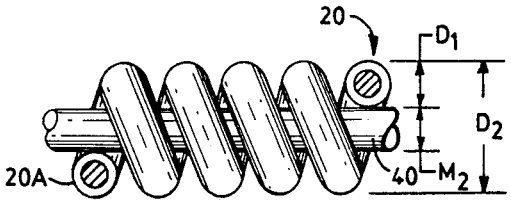
FIG. 5 illustrates a primary coil which is wound around a secondary mandrel to form the coiled coil filament.
Figure 6:
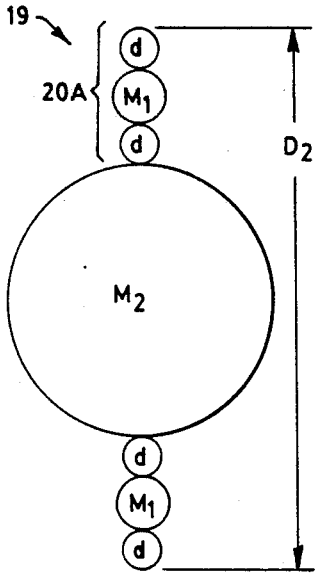
FIG. 6 illustrates the various parameters related to determining the outer diameter of a coiled coil filament of the present invention.

The method of forming the coiled coil filament of the present invention is represented by FIGS. 4–6.

With reference to FIG. 4, the present method comprises the steps of (a) providing a strand of fibrous filament wire 19 having a particular length L and a diameter d (for a particular wattage, voltage and efficiency) and (b) winding filament wire 19 around a primary mandrel 30 having a diameter of $M_1$ to produce a primary coil 20A.

With reference to FIG. 5, the method of the present invention further includes the step (3) of winding the primary coil 20A around a secondary mandrel 40 having a secondary mandrel diameter of $M_2$ to produce a coiled coil filament configuration, where;

$$A \leqq B \leqq 10.0.$$

As illustrated in FIGS. 4 and 5 respectively, the primary winding diameter $D_1$ and the secondary winding diameter $D_2$ of the filament are defined as follows:

$D_1=d(A+2)$ where d equals the filament wire diameter and $1.40 \leqq A \leqq 3.00$ and $3.0 \leqq B \leqq 10.0$ and where the section length, SL, between the supports satisfies the equations, $SL \leqq \frac{1}{2}$ BL and $SL \leqq 20D_2$ (BL=filament body length)

such that the filament exhibits an increase in compactness and retains or exhibits an increase in structural rigidity.

Surprisingly it has been discovered that B can range from about 3.0 to about 10.0 (when A satisfies the equation $1.4 \leqq A \leqq 3.0$ and when the primary pitch is decreased so that the inner pitch (IP) satisfies the condition $1.04 \leqq IP \leqq 1.35$ and where:

$$IP = \frac{(B(A+2)+1)*PP}{(B(A+2)+2)}$$

and where the winding is further improved by decreasing the primary pitch (PP) from about 155% to as low as about 125%, and by selecting the value of B such that IP is kept as close as possible to the center of the range given by the equation $1.04 \leqq IP \leqq 1.35$.

The method of the present invention further includes the step of (4) removing substantially all of the core of the coiled coil filament 20 except for the core in the filament legs 21. The core in legs 21 is preferably left intact in order to preserve the structural integrity of filament when it is mounted within the envelope and crimped or attached by the legs to a mounting means.

FIG. 6 illustrates the outer diameter $D_2$ of the filament winding illustrated in FIG. 5, wherein the primary mandrel diameter $M_1$ is greater than the diameter of filament wire 19 and the secondary mandrel diameter $M_2$ is greater than the diameter of the primary filament coil 20A.

The most preferred coil configuration is centered in the bulb (CC8 configuration) to equalize bulb wall temperature. At the higher wattages, this allows bulb wall loading to be minimized. At the lower wattages, this allows the minimum bulb wall temperature (required for operation of the tungsten halogen cycle) to be achieved without cold spots.

Centering the coil in the bulb is also important for filaments focused in reflectors since this equalizes the light distribution about the central axis of the reflector.

Figure 7:
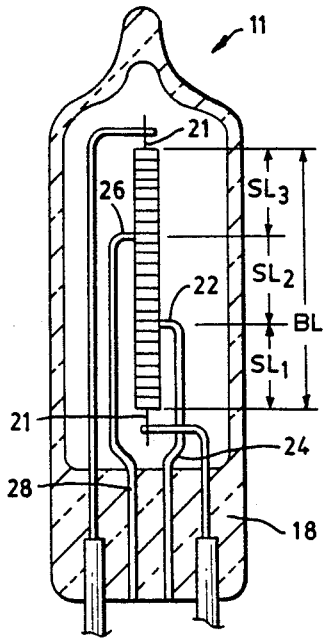
FIG. 7 illustrates a lamp of the type depicted in FIG. 1, modified in accordance with the present invention, and identifying the various parameters related to determining the overall filament length (BL) and the section length (SL) of a coiled coil filament.
Figure 8A:
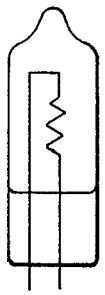
FIG. 8 illustrates some possible filament configurations of the present invention (A), (B), and (C), useful to reduce filament length.
Figure 8B:
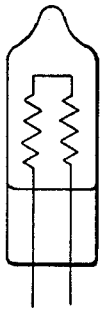
Figure 8C:
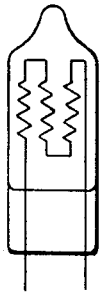

FIG. 7 illustrates the preferred arrangement and spacing of the intermediate filament supports 22 and 26 In the most preferred embodiments of the present invention the distance ($SL_1$) from leg 21 to support 22 (and SL3, the distance from leg 21 to support 26) is approximately equal to the distance ($SL_2$) from support 22 to support 26, although other support spacing may be used if desired. As illustrated, supports 22 and 26 are preferably mounted directly in the press seal 18 of lamp 11 at positions 24 and 28, respectively.

Advantageously, the preferred intermediate filament supports 22 and 26 are small, generally less than about 10 mils in diameter, thus minimizing heat conduction from the lighted filament.

Advantageously, the preferred supports are not in contact with the outer bulb, thereby minimizing thermal conduction from the lighted filament.

The intermediate filament supports 22 and 26 are clamped to the filament, preferably so as to provide approximately equal sections of filament. Coil sag is thus minimized over a number of smaller sections of filament.

Advantageously, the intermediate filament supports are stiff enough to dampen most coil vibrations and to serve as nonmovable supports for the filament.

It is preferred that the support routing (from the clamped filament to the press) be distributed angularly about the circumference of the circular cross-section of the outer envelope so as to tend to equalize the scattered light from these supports.

The preferred system of supports described herein allows the use of a sufficient number of supports so that (especially for those cases where an extremely long filament is needed to provide the watts and lumens at a predetermined voltage) a high degree of compacting becomes possible through the use of large mandrel ratios.

The shorter coil achieved in this manner should preferably be axially centered in the glass envelope for the reasons given above when the filament is to be utilized in a reflector. This shorter axial coil can result in a more efficient and simpler reflector and lens design since stray light is reduced, that is, channeled into the central angular region in front of the reflector where it can be more easily controlled.

The present invention will be further illustrated with reference to the following examples which aid in the understanding of the present invention, but which are not to be construed as limitations thereof.

EXAMPLES

To illustrate the improvement in coil or filament compactness through the use of larger mandrel ratios, particularly where the secondary mandrel ratio is greater than the primary mandrel ratio, two lamps having a visible difference in value and wattage and voltage will be used: a 105 watt lamp operated at 245 volts and a 35 watt lamp operated at 84 volts.

Each example illustrates first a filament which was wound using low mandrel ratios, which was thought to be the preferred method of developing a filament which exhibits a high degree of structural rigidity but instead the rigidity is between the supported portions of the filament (see "Sample Winding").

When subjected to shock, the long filaments tend to vibrate excessively. This is due in part to their length and to the fact that these filaments are heated less uniformly due to the closer or smaller inner pitch that results from small mandrel ratios.

Each example then describes the improved method of winding the filament with the use of larger values of mandrel ratios in order to achieve a high degree of compactness and thereby channel the light emitted therefrom into the central angular regions of the reflector of the lamp (see, "Improved Winding").

105 WATTS/245 VOLTS
STARTING WIRE Length (L/d) = 25026

| | Sample Winding | Improved Winding #1 | Improved Winding #2 | Improved Winding #3 |
|---|---|---|---|---|
| A | 1.50 | 2.00 | 2.00 | 2.00 |
| B | 1.50 | 2.40 | 3.58 | 4.50 |
| Primary Pitch (PP) | 1.55 | 1.55 | 1.50 | 1.50 |
| Secondary Pitch (SP) | 1.50 | 1.50 | 1.50 | 1.50 |
| Factor | 325 | 762 | 1392 | 2091 |
| Inner Pitch (IP) | 1.14 | 1.21 | 1.21 | 1.17 |
| BL/D | 77:1 | 33:1 | 18:1 | 12:1 |
| BL | $77D_2$ (41.7 mm) | $33D_2$ (25.5 mm) | $18D_2$ (17.7 mm) | $12D_2$ (13.8 mm) |
| SL (1 Support) | $38.5D_2$ | $16.5D_2$ | $9D_2$ | $6D_2$ |
| SL (2 Supports) | $25.7D_2$ | $11D_2$ | | |
| SL (3 Supports) | $19.3D_2$ | $8.3D_2$ | | |

Where $BL/D_2$ = (L/D/(Factor))
BL = Body Length
$D_2$ = Outer Length
Factor = $(pi^2/PP*SP)(A + 1)(A + 2)(B + 1)(B + 2)$
where pi = 3.14159

Referring to the 105 watt/245 volt lamp, it is noted, first of all, that such a lamp will utilize an extremely long wire of thin diameter, as exhibited by the high value obtained from the ratio of length to wire diameter (L/d), therefore, optimum winding of such a wire will be extremely important in such a lamp.

In the sample winding where the mandrel ratios are low, the resulting body length (BL) to outer diameter ($D_2$) ratio is about 77:1, this results in a long flimsy filament which will ultimately require at least two or more additional filament supports to support such a filament within a small incandescent lamp envelope.

The improved windings on the other hand, utilize larger mandrel ratios, particularly a secondary mandrel ratio that is larger than a primary mandrel ratio, which results in successively smaller body length to outer diameter ratios of 33, 18 and 12 to 1.

Illustratively, improved filament designs #2 and #3 are much more compact and should require either 1 or no supports compared to 3 or 4 supports needed by the sample winding.

If these filaments are to be used in a reflector lamp such as the PAR38 with a focal length of about 11.4 mm then the total length of an axially mounted filament must be no longer than twice the focal length or 23 mm. Improved winding #1 has a length that will just fit if we have a slight recess in the base but the sample winding will have to be installed in a double or triple hung configuration which will result in a significant focus loss due to its length and off axis configuration.

In each of the above examples, compacting is achieved by greater mandrel ratios and the upper limit in the mandrel ratio values is determined by the body length (BL) of the ultimate filament design being greater than or equal to the outer diameter ($D_2$) of the resulting filament.

A reflector type lamp having a reduction in focus loss and in reflector collection efficiency includes, among other things, a light source having a filament design that has a primary winding diameter, $D_1$, and the secondary winding diameter, $D_2$, where $D_1=d(A+2)$ and $D_2 = D_1 (B+2)$ wherein d is equal to the filament wire diameter and $$1.40 \leqq A \leqq 3.00 \text{ and } 3.0 \leqq B \leqq 10.0$$

Due to the compactness of such a filament within the light source, more of the light emitted therefrom is channeled into the central angular region of the reflector, which in turn results in an increase in candle power of the beam of the lamp.

The following comparative test should be illustrative in clarifying the present invention.

The test was conducted with two hard glass halogen (HGH) capsules having wattages close to 45 watts and operating at a voltage of about 84 volts but having filaments of different lengths. A 0.45 inch focal length, continuous contour (no rear cup recess) aluminum, parabolic reflector was used with a PAR38 flood lens having a center filled with a continuous pattern.

PAR38 FLOOD LAMPS - HGH CAPSULES

| | A | B |
|---|---|---|
| | 45 Watt/84 Volts | 46.6 Watt/84 Volts |
| Starting Wire | Length (L) / 334.4 mm/1.92 mils | Diameter (d) 355.5 mm/1.96 mil |
| L/d | 6857 | 7141 |
| Envelope Size | T 3 | T 4 |
| Primary Mandrel Ratio (A) | 1.95 | 1.78 |
| Secondary Mandrel Ratio (B) | 2.44 | 1.40 |
| Filament Length (13.21mm) | 0.305 in (7.5mm) | 0.520 in |
| Outer Diameter ($D_2$) | 33.68 mils | 25.24 mils |
| Factor | 364 | 756 |
| $B1/D_2$ | 9.5:1 | 18.8:1 |
| Efficiency of Utilization (Reflector) | 67% | 62% |
| Lower Output (of capsule) | 900 lumens | 790 lumens |
| Primary Pitch | 1.55 | 1.55 |
| Secondary Pitch | 1.50 | 1.50 |

The candlepower versus angle from center of the two lamps was next measured. Lamp A had a beam angle of about 24° and a flood angle of about 41°, while lamp B had a beam angle of about 26° and a flood angle of about 48°.

Without the lens, the longer filament gave a minimum beam size of 40° while the shorter filament gave a minimum beam size of 27°. These were the relatively sharp visual edges when adjusted to minimum beam size.

The longer filament produces more spread into the tails of the pattern and consequently has a lower efficiency of utilization, 62% compared to 67% for the shorter filament. This illustrates the advantage of improved collection for the shorter, more compact filament design of the present invention.

The aforementioned example also illustrates that in designing filament- configurations for reflector-type lamp applications it is preferable to utilize a filament design that evenly spreads out the light energy throughout the central angular region, while maintaining a reasonable amount of compactness, in order to simplify the task of shaping the light emitted from the lamp with an appropriate lens.

A long filament (low mandrel ratios) on the other hand spreads the light out too much, beyond the desired central region, such that portions of the reflector will be hit which will greatly disperse the light, making it much more difficult to shape the beam with a lens.

A filament design that has a small diameter also tends to have a hot spot in the middle which creates a bright spot in the middle of the filament that makes it difficult to disperse the light effectively with a lens.

With respect to designing reflector type lamps for operating at high voltages, especially for overseas operation e.g., at 225 and 245 volts, such lamps typically require starting off with extremely long filament wires.

In addition, filaments designed to operate at line voltage such as 120 or 130 volts also require starting with a long filament wire.

Thus, the improved method for reducing focus loss and improving collection efficiency of the present invention will provide for winding a filament wire into a compact coil which is especially useful for these applications and can lead to enhanced operation at high voltages since typical winding techniques have led to extremely long filaments requiring larger envelopes, more complex mounting arrangements and a greater dispersion of light.

Furthermore, the aforementioned filament design can also lead to operation without voltage reducing or rectifying means (e.g., a diode) voltage reducing or modulation of the light and power fluctuations that result from the use of such rectifying means. Elimination of the rectifying means is particularly important in the 225 and 245 volt range since the small filament mass leads to greater thermal fluctuations and useful where small reflector lamp designs are sought due to the heat generated by the lamp capsule that the rectifier is exposed to.

The more compact coil that results from the use of this support system also leads to a smaller capsule size which provides the following heretofore unavailable advantages:

1. Allows for the operation of lower wattage tungsten halogen capsules at higher voltages since the bulb wall loading is increased;
2. Allows for the use of high pressure tungsten halogen capsules, which in turn leads to lower capsule energy and thus improved containment during lamp arc-out at lamp failure; and
3. Allows for lower overall material costs for lamp parts such as glass, fill gas, and outer jacket.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

I claim:

1. An incandescent filament comprising a coiled coil of refractory metal wire having a body length, BL, and a diameter, d, wherein the primary winding diameter, $D_1$, and the secondary winding diameter, $D_2$, of said filament are defined by the equations:

$D_1 = d(A+2)$ ;

$D_2 = D_1(B+2)$;

wherein:

$1.40 \leqq A \leqq 3\ 00$; and $\leqq B \leqq 10.0$;

said coiled coil filament requiring at least one intermediate support for the use thereof, the distance between the mounted ends of said filament and said support, SL, satisfying the equations:

$SL \leqq (\frac{1}{2})\ BL$ and $SL \leqq 20D_2$;

and the inner pitch, IP, of said coiled coil filament is defined as follows:

$$IP \frac{(B(A+2)+1)*PP}{(B(A+2)+2)}$$

wherein PP is the primary pitch of said coiled coil filament.

2. The coiled coil incandescent filament of claim 1, wherein the inner pitch (IP) satisfies the condition $1.04 \leqq IP \leqq 1.35$.

3. The coiled coil incandescent filament of claim 1, wherein the geometry of said coiled coil filament is further defined by the equation:

$$BL \geqq D_2$$

wherein:

BL = the body length of the filament.

4. The coiled coil incandescent filament of claim 1, wherein the primary pitch ratio and the secondary pitch ratio are both less than or equal to about 1.55.

5. The coiled coil incandescent filament of claim wherein the secondary pitch is in the range of from about 1.45 to about 1.75.

6. The coiled coil incandescent filament of claim 1, wherein the diameter of said coiled coil filament is less than or equal to about 4.5 mils.

7. The coiled coil incandescent filament of claim 1, wherein the refractory metal wire comprises tungsten.

8. The coiled coil incandescent filament of claim 1, wherein the coil further includes a skip space for the support.

9. The coiled coil incandescent filament of claim 1, which further requires at least one intermediate support for the use thereof.

10. The coiled coil incandescent filament of claim 9, wherein the intermediate supports are less than about 10 mils in diameter.

11. An incandescent lamp comprising a light transmissive envelope having a body and a neck, a base mounted on said neck of said envelope, said base having means for receiving electrical power from an external source, and a filament, which together with said electrical power receiving means completes an electrical circuit in said envelope, said filament comprising:

a compact coiled coil of refractory metal wire having a body length, BL, and a diameter, d, wherein the primary winding diameter, $D_1$, and the secondary winding diameter, $D_2$, of said filament are defined by the equations:

$D_1 = d(A+2)$;

$D_2 = D_1(B+2)$;

wherein:

$1.40 \leqq A \leqq 3.00 \leqq$ and $3.00 \leqq B \leqq 10.0$;

said coiled coil filament requiring at least one intermediate support for the use thereof, the distance between the mounted ends of said filament and said support, SL, satisfying the equations:

$SL \leqq (\frac{1}{2})\ BL$ and $SL \leqq 20D_2$;

and the inner pitch, IP, of said coiled coil filament is defined as follows:

$$IP = \frac{(B(A+2)+1)*PP}{(B(A+2)+2)}$$

wherein PP is the primary pitch of said coiled coil filament.

12. The incandescent lamp of claim 11, wherein the inner pitch (IP) of said filament satisfies the condition $1.04 \leqq IP \leqq 1.35$.

13. The incandescent lamp of claim 11, which is a reflector-type lamp.

14. The incandescent lamp of claim 11, wherein the diameter of said coiled coil filament is less than or equal to about 4.5 mils.

15. The lamp according to claim 11, wherein said envelope includes an infrared reflective coating such that infrared light is reflected back to said filament.

16. The lamp according to claim 11, wherein said lamp further includes rectifying or other voltage reducing means electrically coupled to said electrical power means, in series with said filament, and further coupled to a voltage source thereby reducing the voltage across said filament.

17. The lamp of claim 11, wherein the refractory metal wire of the filament comprises tungsten.

18. The lamp of claim 11, wherein said lamp is a tungsten halogen lamp having a halogen or a halide as at least a part of its fill gas.

19. The lamp of claim 18, wherein the filament coil configuration is centered in the bulb.

* * * * *